US010039354B2

(12) United States Patent
Van der Laan

(10) Patent No.: US 10,039,354 B2
(45) Date of Patent: Aug. 7, 2018

(54) GARMENT HOLDING DEVICE

(71) Applicant: makinori lifestyle b.v., Vught (NL)

(72) Inventor: Teun Kornelis Van der Laan, Amsterdam (NL)

(73) Assignee: MAKINORI LIFESTYLE B.V., Vught (NL)

( * ) Notice: Subject to any disclaimer, the term of this patent is extended or adjusted under 35 U.S.C. 154(b) by 139 days.

(21) Appl. No.: 14/916,584

(22) PCT Filed: Aug. 5, 2014

(86) PCT No.: PCT/NL2014/050547
§ 371 (c)(1),
(2) Date: Mar. 4, 2016

(87) PCT Pub. No.: WO2015/034349
PCT Pub. Date: Mar. 12, 2015

(65) Prior Publication Data

US 2016/0213109 A1 Jul. 28, 2016

(30) Foreign Application Priority Data

Sep. 5, 2013 (NL) ..... 2011394

(51) Int. Cl.
*A45C 3/00* (2006.01)
*A45C 13/03* (2006.01)
*A47G 25/14* (2006.01)

(52) U.S. Cl.
CPC ..... *A45C 3/004* (2013.01); *A45C 3/00* (2013.01); *A45C 13/03* (2013.01); *A47G 25/14* (2013.01)

(58) Field of Classification Search
CPC ..... A46C 3/00; A46C 3/004; A46C 3/007; A46C 3/008; A46C 13/03; B65H 18/08; A47G 25/14; A63B 21/00; A63B 21/4037; D06F 89/02; D06F 73/00; B65D 85/18; A45C 13/00
See application file for complete search history.

(56) References Cited

U.S. PATENT DOCUMENTS 1,094,009 A * 4/1914 Parkhurst ..... B25H 3/02 206/373
1,556,507 A * 10/1925 Gronauer ..... A47G 25/14 211/180
2,020,870 A * 11/1935 Benoit ..... B65D 85/325 206/521.15
2,244,940 A * 6/1941 Carruth ..... B65D 3/10 229/117.01

(Continued)

FOREIGN PATENT DOCUMENTS

WO 2012134267 A1 10/2012

*Primary Examiner* — Ismael Izaguirre
(74) *Attorney, Agent, or Firm* — The Webb Law Firm

(57) ABSTRACT

The present invention relates to a garment holding device comprising a main sheet of material rollable in a rolling direction and at least one cloth attachment means attached to said main sheet, wherein the main sheet is provided with at least two elongated elevated zones on the front side of the main sheet, essentially mutually parallel arranged at or near the edges of said main sheet and parallel to said rolling direction, such that when the device is rolled up, a curved spacing is created for holding a suit or another garment, without substantial forces being exerted thereto and without sharp bends.

16 Claims, 5 Drawing Sheets

(56) References Cited

U.S. PATENT DOCUMENTS

| | | | | | |
|---|---|---|---|---|---|
| 2,296,080 | A * | 9/1942 | Arrowood | A45C 3/00 | 206/287.1 |
| 2,319,497 | A * | 5/1943 | Franklin | G09F 5/02 | 190/107 |
| 2,502,033 | A * | 3/1950 | Bohn | A45C 7/0095 | 206/278 |
| 4,467,917 | A | 8/1984 | Hayashi | | |
| 4,967,986 | A | 11/1990 | Schildkraut | | |
| 5,255,766 | A * | 10/1993 | Deconinck | A45C 13/03 | 190/110 |
| 5,624,026 | A | 4/1997 | Chernoff | | |
| 6,499,590 | B1 | 12/2002 | Godshaw et al. | | |
| 7,134,535 | B1 * | 11/2006 | Horvat | A45C 7/0077 | 190/107 |
| 8,769,742 | B2 * | 7/2014 | Thornton | A47G 9/062 | 5/417 |
| 9,096,971 | B2 * | 8/2015 | van der Laan | A45C 3/004 | |

* cited by examiner

GARMENT HOLDING DEVICE

CROSS-REFERENCE TO RELATED APPLICATIONS

This application is the United States national phase of International Application No. PCT/NL2014/050547 filed Aug. 5, 2014, and claims priority to Dutch Patent Application No. 2011394 filed Sep. 5, 2013, the disclosures of which are hereby incorporated in their entirety by reference.

BACKGROUND OF THE INVENTION

Field of the Invention

The present invention relates to a garment holding device.

Description of Related Art

Such devices are known, and serve to store and/or transport garments, such as suits and dresses or gowns. Their advantage is that they enable compact storage and transport and convenient handling of the garments.

The U.S. Pat. No. 5,624,026 issued Mar. 20, 1995 discloses a garment holding device for use with various types of luggage comprising a substantially cylindrical hollow tube about which suits and other garments can be completely wrapped, a fabric cover for holding garments securely about the outer surface of the tube, and a flexible hanger which is capable of holding suits and other garments against the outside of the tube while being flexible enough to conform to the curvature of the tube. A fabric cover wraps around the garments and the tube and holds the garments securely against the outer surface of the tube. Because the garments will be rolled instead of folded over 180 degrees, wrinkling of the garments will be reduced. The hollow center of the cylinder is utilized to carry bulky and awkward shaped objects such as shoes. The way the suits and garments are wrapped around the outside of a cylinder allows the luggage to be compact and easy to carry. Additionally, the garments no longer have to be folded and incur wrinkling, but can be gently wrapped around the outside of the cylinder. This product is available on the market under the tradename Skyroller®.

Although the known device of U.S. Pat. No. 5,624,026 is an improvement over traditional garment holders that require a suit and other clothes to be folded into two halves or more parts, which almost certainly results in wrinkling of the respective piece of garment and is not compact, the known device still suffers from the disadvantage that it causes wrinkling of the suit or other garment transported and/or stored. Therefore it is a goal of the present invention to provide an improved garment holding device, in particular a garment holding device that prevents wrinkling, while maintaining the compactness of the known device described in U.S. Pat. No. 5,624,026.

SUMMARY OF THE INVENTION

This goal is realized by a garment holding device having a main sheet of material rollable in a rolling direction and at least one cloth attachment means attached to said main sheet.

Because the main sheet is provided with at least two elongated elevated zones on the front side of the main sheet, essentially mutually parallel arranged at or near the edges of said main sheet and parallel to said rolling direction, when the device is rolled up, a curved spacing is created in which a suit suits, or another garment. In this spacing, the garment is held without substantial forces being exerted thereto and without sharp bends. As a result, the garment is much less likely to wrinkle or crease than garments in the known garment holding devices, such as that of U.S. Pat. No. 5,624,026 described above.

The elongated elevated zones preferably have a thickness of at least 4 mm, and in particular more than 9 mm, such that in a rolled up configuration, a garment storage space with a helix shaped cross section is obtained. In particular, the elevated zones are made from a somewhat resilient material, that closes the device at its sides such that no moist can enter, but is not compressed by the rolling force required for rolling up the device.

Another advantage of the device according to the invention is that it facilitates in making the rolled device that holds the garment closed for dust, water, etc. and therefore it facilitates a better protection of the garment (s) in the rolled device.

In particular, the elevated zones may comprise a moist absorbing material, strip, part or layer. These parts form the closure of the device once rolled up, and are then located at the position where the risk if incoming dirt or moist is the highest.

The main sheet is either continuously or at multiple bending lines bendable in the rolling direction. This embodiment offers a simple construction and very reduced folding of the garments, hence good anti-creasing effect.

The main sheet may for instance be made from a (reinforced) textile, but more rigid materials may be suitable, such as a plastics like PP, PE or PVC.

Another option is to use a paper or cardboard, or in particular ribbed cardboard. The elongated elevated zones may be from the same or another paper material, or for instance from a foam. This combination gives a very light result, which makes the device especially suitable for post order deliveries, or as a give away in shops.

In those cases wherein the device according to the invention, and in particular the lightweight versions such as the paper versions are to be shipped empty, but in large quantities, such as may be the case when shipping from a manufacturer of the device to a sales point, the device may be delivered in separate parts. An amount of main sheets may then be stacked, and the elevated zones may be delivered separately, and be mounted with double sided tape locally, before use. The same goes for a corus, which may for example be a card-board box with a polygonal cross section. This way, flat packages can be composed.

Yet another option is to use bamboo as a material.

In another embodiment, the main sheet has, in a direction perpendicular to the rolling direction, over at least a part of its length in the rolling direction, a rigidity sufficiently high to take up an external radial point load of 25-35 N on the outside of the main sheet when said main sheet is in a rolled up state, without deformation of more than 10 mm of each point on the surface area. Due to these measures, the device may be handled in normal traveling circumstances, such as occur when taking an airplane, without having to worry about the garments being pressed together and being wrinkled or creased. For instance, a suitcase of 23 kg, as is commonly used in airplane travel, may rest with a corner on the device according to the invention. These features may be realized in a main sheet of a single layer material as well as a multi-layered material of which at least a single layer is relatively rigid.

In yet another embodiment, the aforementioned rigidity is sufficiently high to take up an external radial load of 210-270 N equally distributed over a surface area that spans the outside length of the main sheet when said main sheet is in a rolled up state, without deformation of more than 10 mm of each point on the surface area. This allows for somewhat rougher handling of the device, e.g. by putting some other luggage on it, such as a suitcase.

In a further embodiment, a part of the main sheet has a higher rigidity than the rest of the main sheet. This may be realised by a higher density or thickness, another material, a combination or materials or an extra layer. The part of the main sheet with the higher density is the part that forms the outer shell when the device according to the present invention is rolled up.

In another embodiment at least one of the elongated elevated zones and relief zones is provided with recesses in the direction perpendicular to the direction of rolling, for example V-shaped or rectangular shaped. The recesses may have various shapes, and sizes. In combination with sizes and shapes of the elongated elevated zones, the rolling up occurs in segments, i.e., into a prismatic rod with a number of sides.

In a further embodiment of the device, at least one of the elongated elevated zones and relief zones is inflatable. This allows for a more compact storage and transport when the device is not in use, i.e., when it holds no garments.

In yet a further embodiment, the main sheet is coupled to an essentially cylindrical corus, about which the device is rollable. The connection between the main sheet and the corus may be a hinge. The corus then may serve as a weight that prevents the device from rolling up automatically when laid flat on a floor, and it assists in rolling up the device. Its radius may be chosen such that the angle over which the main sheet and a garment are bent is limited to a desired allowed minimum. The corus may be rigid or hollow, and accessible to store objects within if desired.

Preferably, the at least one cloth attachment means is a clothes hanger, wherein the clothes hanger is flexible in the direction of rolling of the device; this allows for more compact rolling. We note that the term "clothes hanger" is to be interpreted in a wide sense, including anything attached to the main sheet that is suitable for carrying garments in or at the device. In particular, (elastic) cords or the like may be used.

In an embodiment, the device comprises a hook suitable for carrying the device in unrolled shape, wherein the hook is integrated with or attached to a clothes hanger. As such, it becomes possible to use the hook for hanging the device at a fixed location, e.g. in a hotel or at home, while meanwhile utilizing the clothes hanger—carried by the hook—for hanging clothes against the unrolled main sheet.

Another embodiment has two clothes hangers attached to the front side of the main sheet, and a folding line in the main sheet between and parallel to said two clothes hangers as well as a hook attached to the main sheet between said two clothes hangers or to a clothes hanger. With this embodiment, it becomes possible to fold the main sheet into two parts, with their backsides against each other, one clothes hanger on each main sheet front side. The hook then serves to hang the device at a cupboard, a stand, or the like. Each clothes hanger then may carry a piece of clothing. When such a device is to be transported, it may easily be straightened with the two pieces of clothing in it, and then be rolled up.

In a further embodiment, the main sheet has a covering sheet attached to it, which covering sheet is suited to cover at least part of the front side of the main sheet and to uncover the main sheet by folding away the covering sheet. Such a covering sheet is suited either separate two pieces of clothing, to further prevent them from wrinkling or creasing when they are being rolled up in the main sheet, or to cover a single piece of clothing before it is being rolled up, which also has an aesthetical function.

In a further embodiment, each of the elongated elevated zones of the main sheet has a higher elongated part and a lower elongated part, wherein each higher part faces the edge to which it is closest, and, when the covering sheet is covering the main sheet, it is positioned over the lower parts of the elongated elevated zones of the main sheet. This has as an advantage that two pieces of clothing fit in the device, each in its own compartment, meanwhile having a compact device. Relief zones may lie over the lower elongated parts when the device is in the rolled up state, for convenient guidance in rolling up.

The invention will now be clarified on the basis of a preferred embodiment, referring to the accompanying drawings and solely as an illustration of the invention and not in limitation thereof. In the drawings:

FIGS. 1*a* and 1*b* show a first embodiment of the invention, respectively in a folded state for hanging, and an elongated state for packing and unpacking, FIG. 2 shows a second embodiment of the invention, similar to the first embodiment but provided with a flap, FIG. 3 shows a third embodiment of the invention, and FIG. 4 shows the cross-section A-A of part of the first embodiment, FIG. 5 shows schematically, not drawn to scale, a cross-section over a fourth embodiment of the invention, provided with a flap having rims;

Figure 1A:
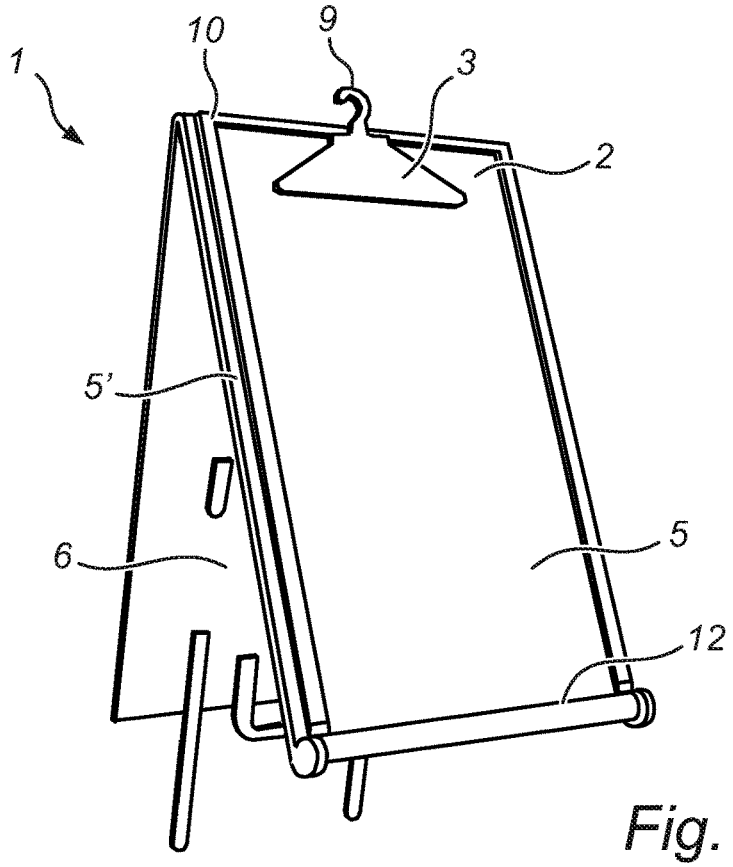
Figure 1B:
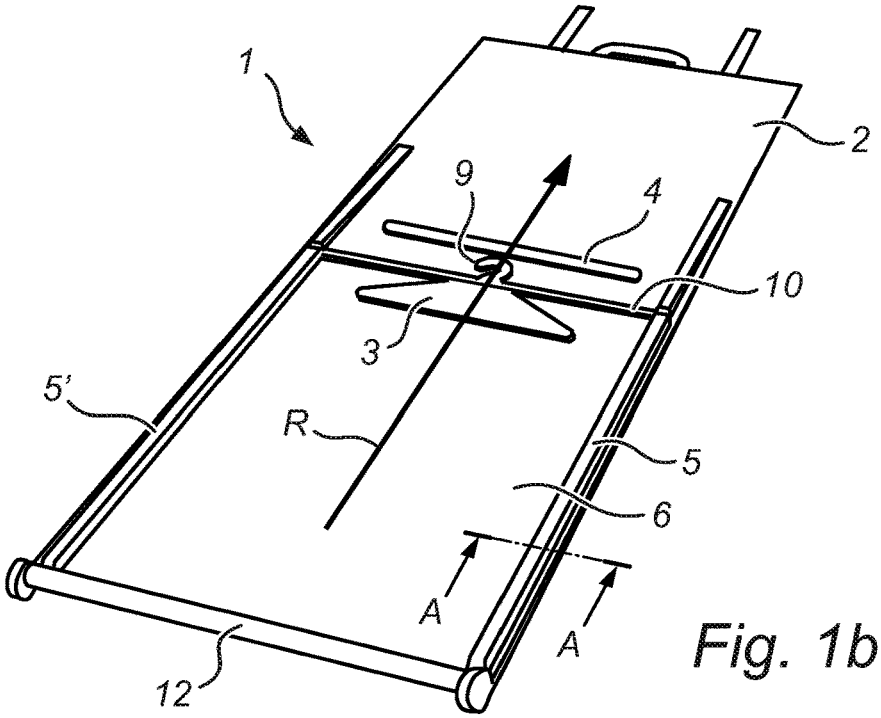

In FIGS. 1*a* and 1*b*, a garment holding device 1 comprises a main sheet 2 of material rollable in a rolling direction R, indicated by an arrow in FIG. 1*b*. Attached to the main sheet 2 are two cloth attachment means in the shape of a clothes hanger 3 and a trouser holder 4.

The main sheet 2 is provided with two elongated elevated zones 5, 5' on the front side of the main sheet (top side in FIG. 1*b*), mutually parallel arranged close to the edges of the main sheet 2 and parallel to the rolling direction R, and at a mutual distance of approximately 60 cm.

The main sheet 2 is continuously bendable over its entire length in the direction R. Alternatively, but not shown, it could be provided with stiff parts and a number, for example five, bending lines, each arranged perpendicular to the rolling direction R. The main sheet 2 is provided with at least two relief zones 6, 6' on the back side of the main sheet, at locations opposing said at least two elevated zones 5, 5' on the front side of the main sheet.

Figure 4:
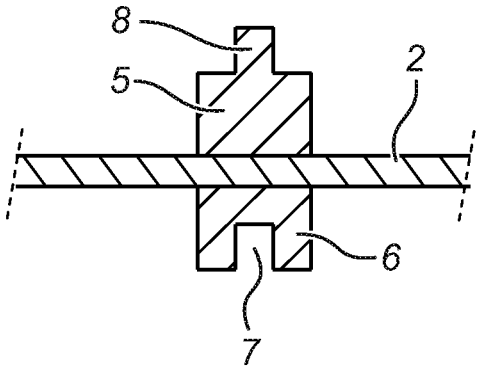

In FIG. 4, a part of the embodiment shown in FIG. 1 is shown in cross-section. Here, the main sheet 2 is visible and the elevated zone 5 on the front side thereof, as well as the relief zone 6 at the rear side of the main sheet. The relief zone 6 is in shape complementary to that of the elevated zone 5, and has a recess 7 that cooperates with peak 8. These measures have as a result that the relief zone 6 cooperates during the rolling up with the elongated elevated zone 5 in guiding said rolling up. The same holds, mutatis mutandis, for the zones 5' and 6'. It is noted that the elevated zones 5, 5' and the relief zones 6, 6' extend along a large part of the length of the main sheet 2, in this embodiment. They are left away only in the zone that is rolled up as last zone, and that serves as a cover of the device. It is not shown, but the main sheet 2 is (see FIG. 1*b*) at its rear side provided with stiffening material, providing it a high rigidity in a direction perpendicular to the rolling direction, in order to provide the device in its rolled up state, possibly with garments in it, with sufficient strength on its outside area to be able to withstand normal handling during transportation, such as carrying the device in busses, airports, airplanes and cars, etc, without substantially deforming and thereby wrinkling or otherwise damaging the clothes rolled up inside the device.

The clothes hanger 3 may hold suits, but of course may also carry a dress, including a ceremonial dress, or any other piece of clothing. Similarly, the trouser holder 4 may hold other things than trousers. The clothes hanger 3 is made of foam with rods inserted in it, in the lateral direction (R being the longitudinal direction), in order to provide it with sufficient stiffness and strength and meanwhile maintaining the flexibility necessary to allow the main sheet 2 to bend and be rolled up.

Further, the clothes hanger 3 is integrated with a hook 9, by which hook 9 the device can be varied in unrolled shape; in this manner it may be hung on a cupboard or a stand (not shown).

The clothes hanger 3 and the trouser holder 4 are both attached to the front side of the main sheet 2, and a folding line coinciding with the edge 10 in the main sheet 2 is located between and parallel to the clothes hanger 3 and the trouser holder 4. An opening (not shown) in the main sheet 2 allows the hook 9 to reach outside when the main sheet is in the rolled state; in this manner it becomes possible for a person to carry the device in its rolled state by the hook, or to hang it by the hook. Not discussed into detail, but present, are various straps and grips for securing the device in its rolled up state respectively for carrying the device in that state, either as a horizontal or vertical roll. Both positions may be beneficial, depending on the circumstances or environment. In particular a shoulder strap is mentioned (but not shown), attached to or near the ends of the device in its rolled state, and long enough to enable a person to carry the device conveniently by putting the strap over her shoulder, while the rolled up device hangs horizontally are hip-height or approximately that height.

A tube 13 is present at the end of the main sheet 2 where rolling is started. Such a tube is convenient for rolling up with a larger radius, with as a result an even smaller risk of wrinkling of the garments. The tube, when given a larger volume, may also be convenient for holding objects, such as a tie or shoes, in it.

Figure 2:
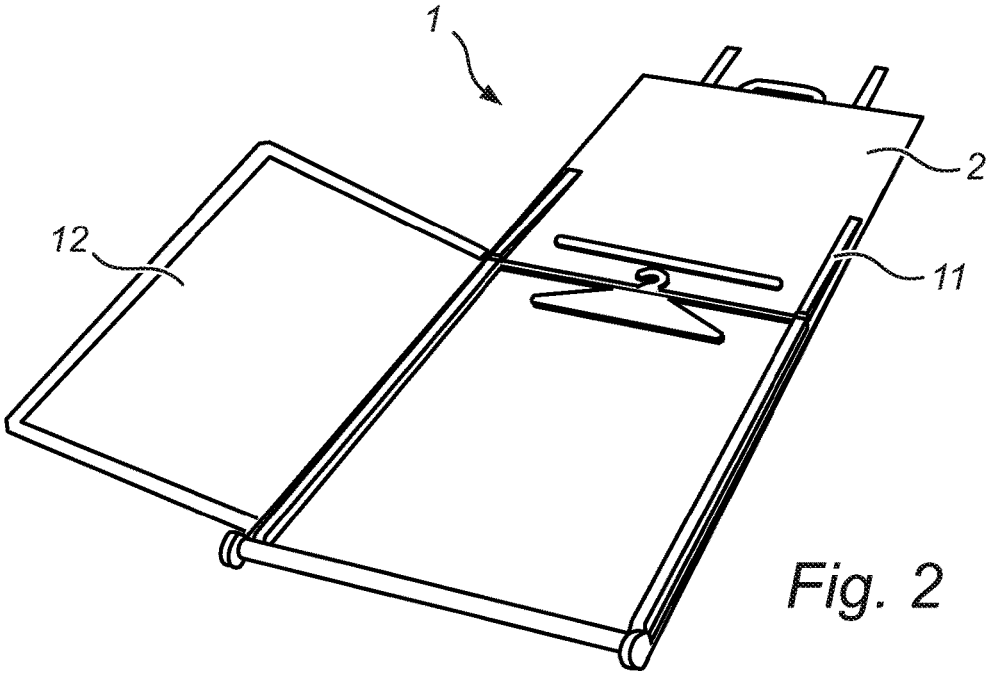
Figure 3:
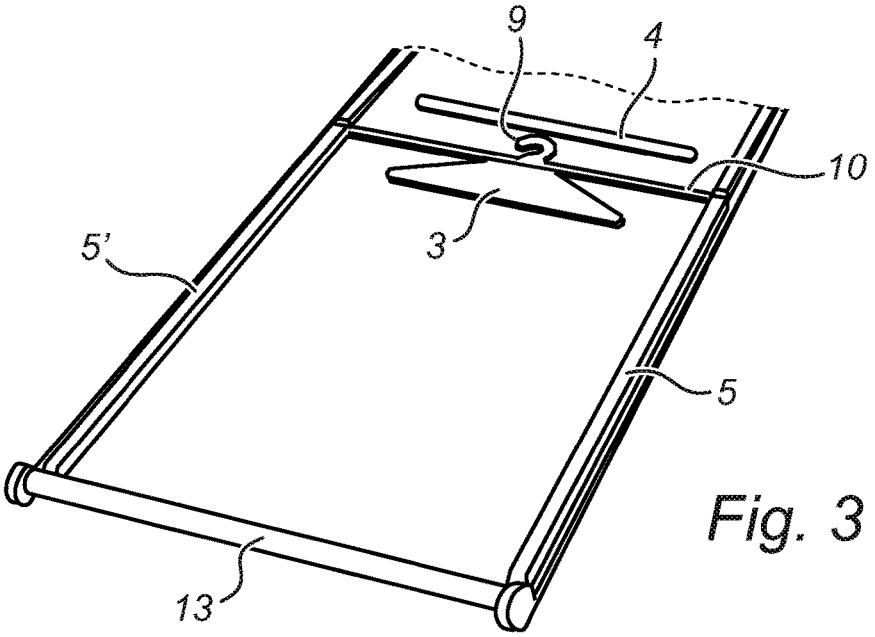

FIG. 2 shows an embodiment almost identical to the embodiment shown in FIG. 1, only differing in that it additionally comprises a covering sheet 12 attached to the main sheet 2, in the shape of a thin transparent plastic sheet. The covering sheet 12 covers, when it is folded over the main sheet 2, one part of the front side of the main sheet 2, viz. one of the two parts meant for one piece of garment, as separated by the folding line coinciding with the edge 10.

Figure 5:
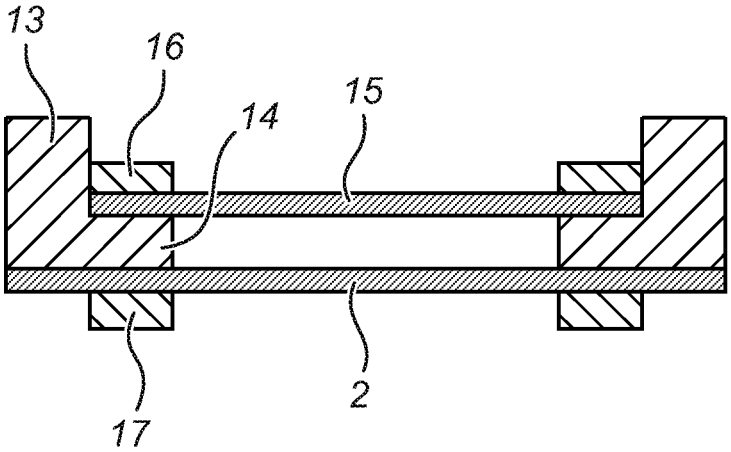

In FIG. 5, in a fourth embodiment of the invention, each of the elongated elevated zones of the main sheet has a higher elongated part 13 and a lower elongated part 14, wherein each higher part faces the edge to which it is closest. The covering sheet or flap 15 has two elevated rims 16 on the side thereof facing away from the main sheet 2 and positioned on the lower parts 13 of the elongated elevated zones of the main sheet 2, when the device is rolled up. Not shown, is a hanger attached to the flap, on the same side thereof as the rims 16. In this embodiment, two pieces of clothing can be stored inside the device, in separate compartments, when the device is rolled up.

Relief zones 17 are attached to the rear side of the main sheet 2. They rest on the rims 16 when the device is in the rolled up state.

Due to the presence of push buttons (not shown) at the edges of the flap 15, the flap is detachable from the main sheet 2 and can be fitted upside down, i.e. with its rims 16 facing the main sheet, in the unrolled state of the device, in order to provide a single, larger compartment instead of two smaller ones.

In this embodiment, the flap 15 is made of stretchable material, which enhances anti-crease effect of the device.

It is noted that the rims 16 may also be omitted, while increasing the height of the relief zones 17. In this manner, the flap 15 is no longer reinforced by the rims, but this function may be taken over by e.g. push buttons by which the flap is attached to the lower elevated parts 14, in particular when stretch material is used for the flap 15. The three illustrated embodiments may also comprise means for automatically rolling up, or stretching, the main sheet 2. These means may be integrated with the elevated zones 5, 5' and/or the relief zones 6, 6'. Such means are known per se, they are for instance applied in artificial satellites for unrolling RF-antennas and also in bracelets.

Figure 6:
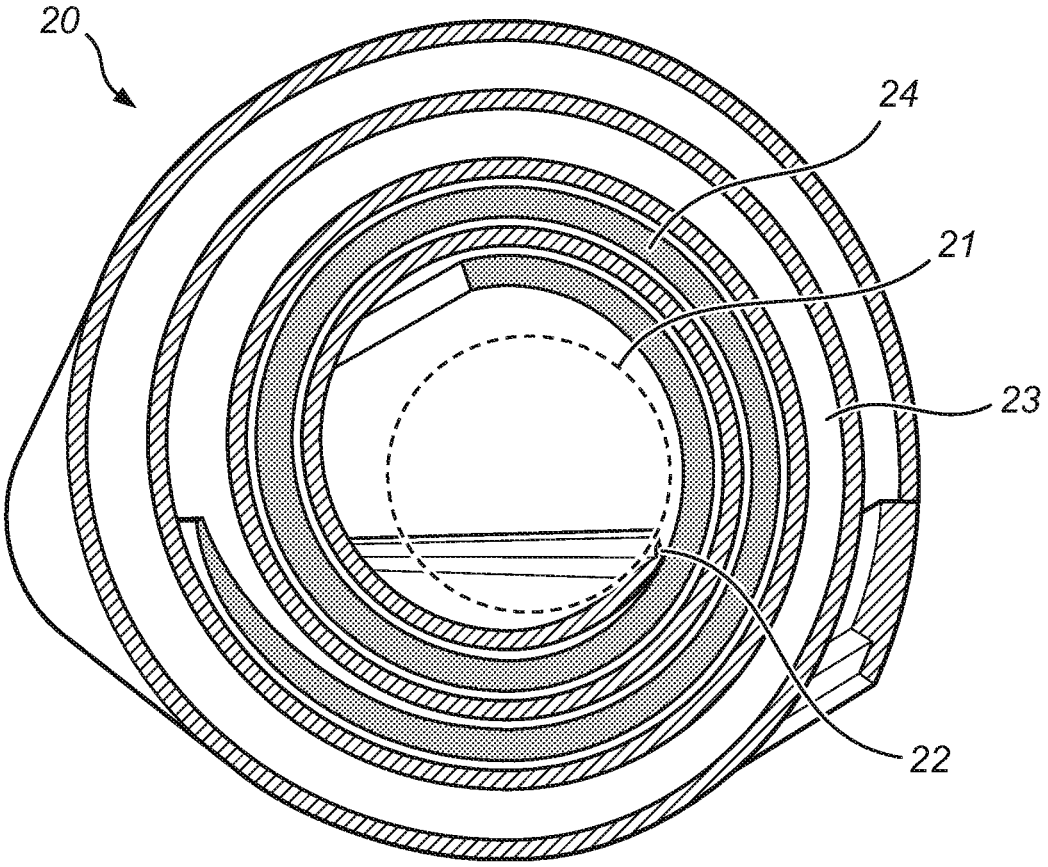
FIG. 6 shows a cross section of a perspective side view of the garment holding device according to the present invention, in a rolled up position.

FIG. 6 shows a perspective side view 20 of a cross section of the garment holding device according to the present invention, in a rolled up position. Visible are the optional corus 21 (dashed) to which the main sheet is connected by a hinge 22. In the closed position, the elevated zones create a curved spacing 23 with a helix shaped cross section is created for holding a suit 24 or another garment, without substantial forces being exerted thereto and without sharp bends.

Variants can be made to the embodiments shown, without leaving the scope of the claims. For example, the main sheet may be made of bamboo rods arranged parallel to the axis of symmetry of the rolled product. Moreover, the elongated elevated zones and relief zones may be somewhat compressible and may have heights that vary in the rolling direction of the main sheet.

Figure 7:
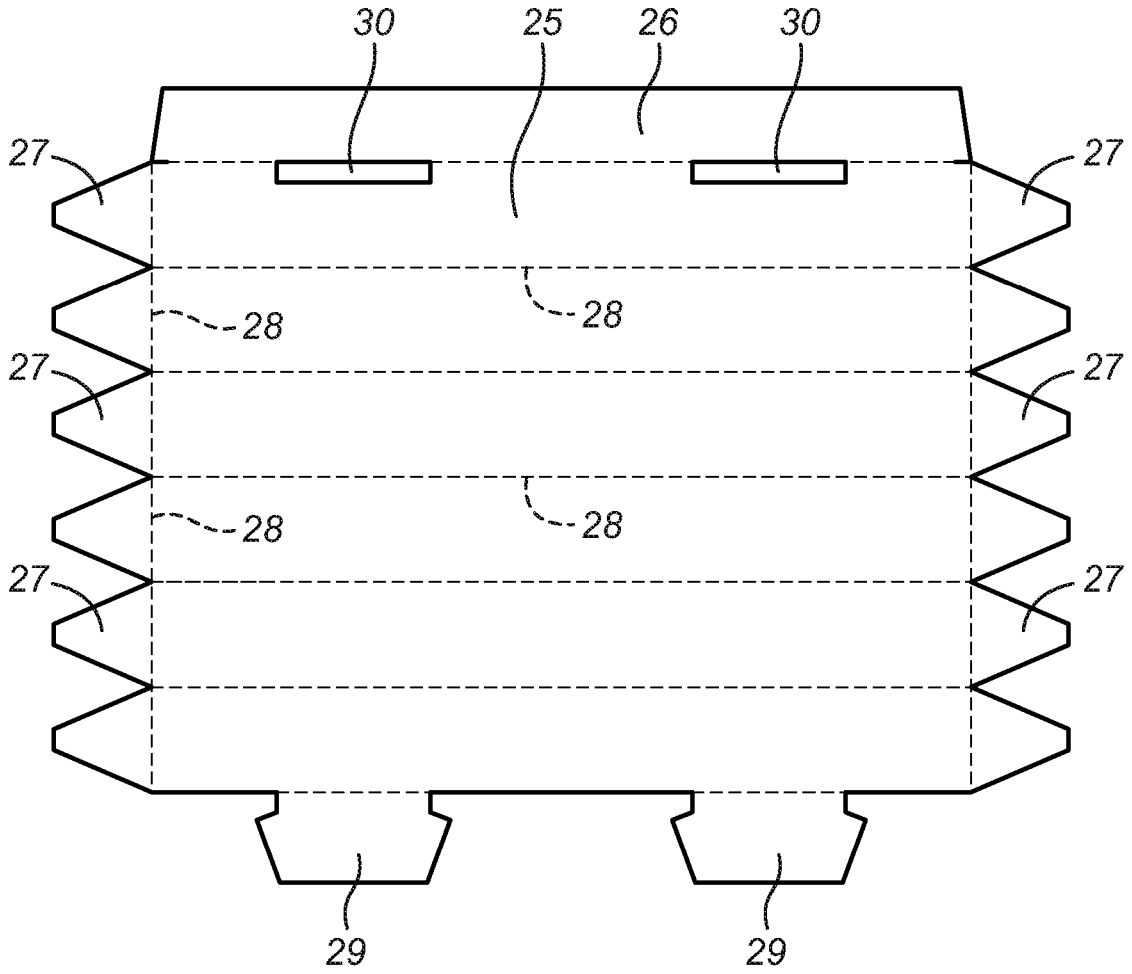
FIG. 7 shows a blank for a corus for a cardboard version of the device according to the present invention.

FIG. 7 shows a blank 25 for a corus of a cardboard version of the present invention. The blank may be integrated with a main sheet, or attachable thereto, for instance by means of a adhesive surface 26. The corus has folding lines, that allow to form a polygonal shape from it. As a blank, the corus can easily be shipped, in particular in large quantities, as a stack. In a rolled up or folded state, the triangular extensions 27 are bent over their folding lines 28 to form a sidewall. Extensions 29 can be clamped in slits 30, to fix the corus in the folded position.

The invention claimed is:

1. A garment holding device comprising a main sheet of material rollable in a rolling direction, wherein the main sheet is provided with at least two elongated elevated zones on the front side of the main sheet, essentially mutually parallel arranged at or near the edges of said main sheet and parallel to said rolling direction, such that when the device is rolled up, a curved spacing is created for holding a suit or another garment, without substantial forces being exerted thereto and without sharp bends, and wherein the main sheet is made from a paper or ribbed cardboard.

2. The garment holding device according to claim 1, in which said main sheet is continuously bendable in said rolling direction.

3. The garment holding device according to claim 1, wherein the elongated elevated zones have a thickness of at least 4 mm, and in particular more than 9 millimeter, such that in a rolled up configuration, a garment storage space with a helix shaped cross section is obtained.

4. The garment holding device according to claim 1, wherein the elevated zones are made from an at least somewhat resilient material, that closes the device at its sides such that no moisture can enter, but is not compressed by the rolling force required for rolling up the device.

5. The garment holding device according to claim 1, in which said main sheet has in a direction perpendicular to the rolling direction, over at least a part of its length in the rolling direction, a rigidity that is sufficiently high to take up a pressing external radial point load of 25-35 N on the outside of the main sheet when said main sheet is in a rolled up state, without deformation of more than 10 mm of each point on the surface area.

6. The garment holding device according to claim 1, in which said main sheet has in a direction perpendicular to the rolling direction, over at least a part of its length in the rolling direction, a rigidity that is sufficiently high to take up a pressing external radial load of 210-270 N equally distributed over a surface area that spans the outside length of the main sheet when said main sheet is in a rolled up state, without deformation of more than 10 mm of each point on the surface area.

7. The garment holding device according to claim 1, further comprising relief zones, wherein at least one of the elongated elevated zones and relief zones is provided with recesses in the direction perpendicular to the direction of rolling, for example V-shaped or rectangular shaped.

8. The garment holding device according to claim 1, in which at least one of the elongated elevated zones and the relief zones is inflatable.

9. The garment holding device according to claim 1, wherein a part of the main sheet has a higher rigidity than the rest of the main sheet, for instance realised by a higher density or thickness, another material, a combination of materials or an extra layer.

10. The garment holding device according to claim 9, comprising a hook suitable for carrying the device in unrolled shape, wherein the hook is integrated with or attached to a garment attachment means.

11. The garment holding device according to claim 1, further comprising two garment attachment means attached to the front side of the main sheet, and a folding line in the main sheet between and parallel to said two garment attachment means as well as a hook attached to the main sheet between said two garment attachment means or to a garment attachment means.

12. The garment holding device according to claim 1, wherein the main sheet is coupled to a corus, about which the device is rollable, and wherein the connection between the main sheet and the corus may be a hinge.

13. The garment holding device according to claim 12, wherein each of the elongated elevated zones of the main sheet has a higher elongated part and a lower elongated part, wherein each higher part faces the edge to which it is closest, and, when a covering sheet is covering the main sheet, it is positioned over the lower parts of the elongated elevated zones of the main sheet.

14. The garment holding device according to claim 1, wherein the relief zones lie over the lower elongated elevated part when the device is in the rolled up state.

15. A method for shipping a plurality of disassembled garment holding devices, comprising the steps of:

Stacking an amount of main sheets of the plurality of disassembled garment holding devices, wherein the main sheets are made from a paper or ribbed cardboard;

Enclosing, in one or more containers, the amount of main sheets and an amount of elevated zones configured to be assembled with the main sheets of the plurality of disassembled garment holding devices;

Shipping the main sheets and elevated zones of the plurality of disassembled garment holding devices for assembly by a receiving party, wherein the main sheets and elevated zones of the plurality of disassembled garment holding devices can be shipped in the same or separate containers;

Assembling the plurality of disassembled garment holding devices by the receiving party once the receiving party has received both the main sheets and the elevated zones of the plurality or disassembled garment holding devices, by assembling each main sheet with at least two elongated zones on the front side of the main sheet, essentially mutually parallel arranged at or near the edges of said main sheet and parallel to a rolling direction, such that when the assembled garment holding device is rolled up, a curved spacing is created for holding a suit or another garment, without substantial forces being exerted thereto and without sharp bends.

16. The method according to claim 15, wherein the disassembled garment device comprises a corus, which is shipped as a flat blank.

* * * * *